United States Patent [19]

Saguchi

[11] Patent Number: 5,076,023

[45] Date of Patent: Dec. 31, 1991

[54] POLISHING-GRINDSTONE MOUNT BASE ASSEMBLY

[76] Inventor: Takeshi Saguchi, 12-11, Ohaza-Uenodai, Fukaya, Saitama-Ken, Japan

[21] Appl. No.: 599,390

[22] Filed: Oct. 18, 1990

[51] Int. Cl.[5] ..... B24D 3/00

[52] U.S. Cl. ..... 51/204; 51/206 NF; 51/207; 51/297

[58] Field of Search ..... 51/204, 206 P, 206.4, 51/206.5, 206 NF, 338–355, 400, 295, 297

[56] References Cited

U.S. PATENT DOCUMENTS 1,393,625 10/1921 Hobbs ..... 51/353

3,203,774 8/1965 Pratt ..... 51/206 R 4,505,076 3/1985 Sunnen ..... 51/206.5

*Primary Examiner*—M. Rachuba

*Attorney, Agent, or Firm*—James B. Middleton

[57] ABSTRACT

A polishing-grindstone mount base assembly has a mount cassette formed of hard rubber. The mount cassette includes a wedge-shaped rib, having a dove-tail-shape in cross-section for engaging the arm of a conveyor-type plane polisher. The mount cassette is fixed to the mount base with bolts of a synthetic resin which will break on excessive impact, allowing the base for separate from the mount to prevent damage to the base. The base has an abrasive layer on the bottom surface, and protective layers of synthetic resin on each side of the abrasive layer to prevent breaking of the abrasive layer.

3 Claims, 2 Drawing Sheets

POLISHING-GRINDSTONE MOUNT BASE ASSEMBLY

INFORMATION DISCLOSURE STATEMENT

Conventionally, the mount base for a polishing grindstone, which is used with a conveyor-type plane polisher for polishing the stones to be used as building construction material, comprises a tool in which a metallic base has a diamond abrasive grain layer attached on the bottom surface thereof, and the base is to be fixed directly to a rigid mount cassette made of synthetic resin with metallic bolts. The mount cassette is then to be fixed to the arm of a polisher. Because of this construction, it somewhat frequently happens that, if the tool touches the corner or other portion of the stone while the polisher is rotating, the cassette is destroyed due to the shock applied, and the abrasive grain layer attached on the base is broken.

The conventional tool of this type using pulverized diamond as abrasive grain is expensive and the tool, once broken, is not reusable.

SUMMARY OF THE INVENTION

The present invention relates generally to a polishing-grindstone mount base assembly for use with a conveyor-type plane polisher, and is more particularly concerned with a polishing-grindstone mount base including protective layers, and shear pins for attaching the base to the arm of the polisher.

The present invention has an object to overcome the above-mentioned drawbacks of the conventional techniques by providing a polishing-grindstone mount base assembly of which a base having an abrasive grain layer formed thereon and a mount cassette are separated from each other when the tool touches the corner or the like of a stone being worked, so that the cassette will not be broken, and also providing a polishing-grindstone base having formed thereon an abrasive grain layer which will not be broken even with such shock mentioned above.

According to one aspect of the present invention, a polishing-grindstone base is provided, comprising a rectangular base body having formed as swollen in the central area of the rectangular bottom surface thereof an abrasive grain layer made of a sintered mixture of pulverized diamond and abrasive grain and also as circularly swollen on the bottom surface thereof on either side of the abrasive grain layer a protective layer made of a synthetic resin.

According to a second aspect of the present invention, a polishing-grindstone mount base assembly is provided, comprising a mount cassette made of a rigid rubber to be fitted in a fitting recess formed on the top of above-mentioned base body, having a wedge-like rib formed on the top thereof and a dovetail-like surface along either side and longitudinally of the rib, the base body and mount cassette being fixed integrally to each other with bolts made of a synthetic resin.

BRIEF DESCRIPTION OF THE DRAWINGS

These and other features and advantages of the present invention will be better understood from the ensuing description made by way of example of the embodiment of the present invention with reference to the drawings in which.

DETAILED DESCRIPTION OF THE PREFERRED EMBODIMENT

Figure 1:
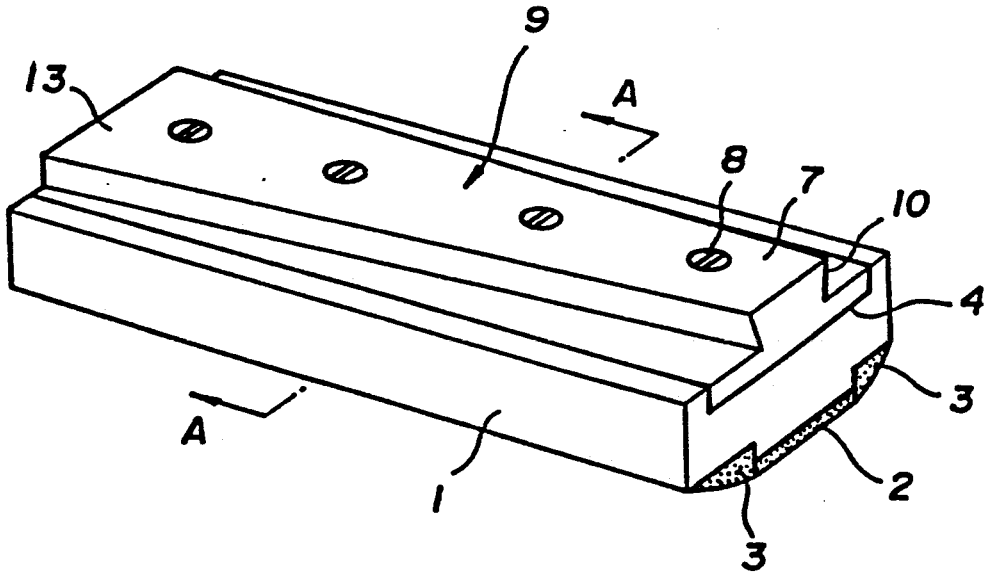
FIG. 1 is a perspective view of the polishing-grindstone mount base.
Figure 2:
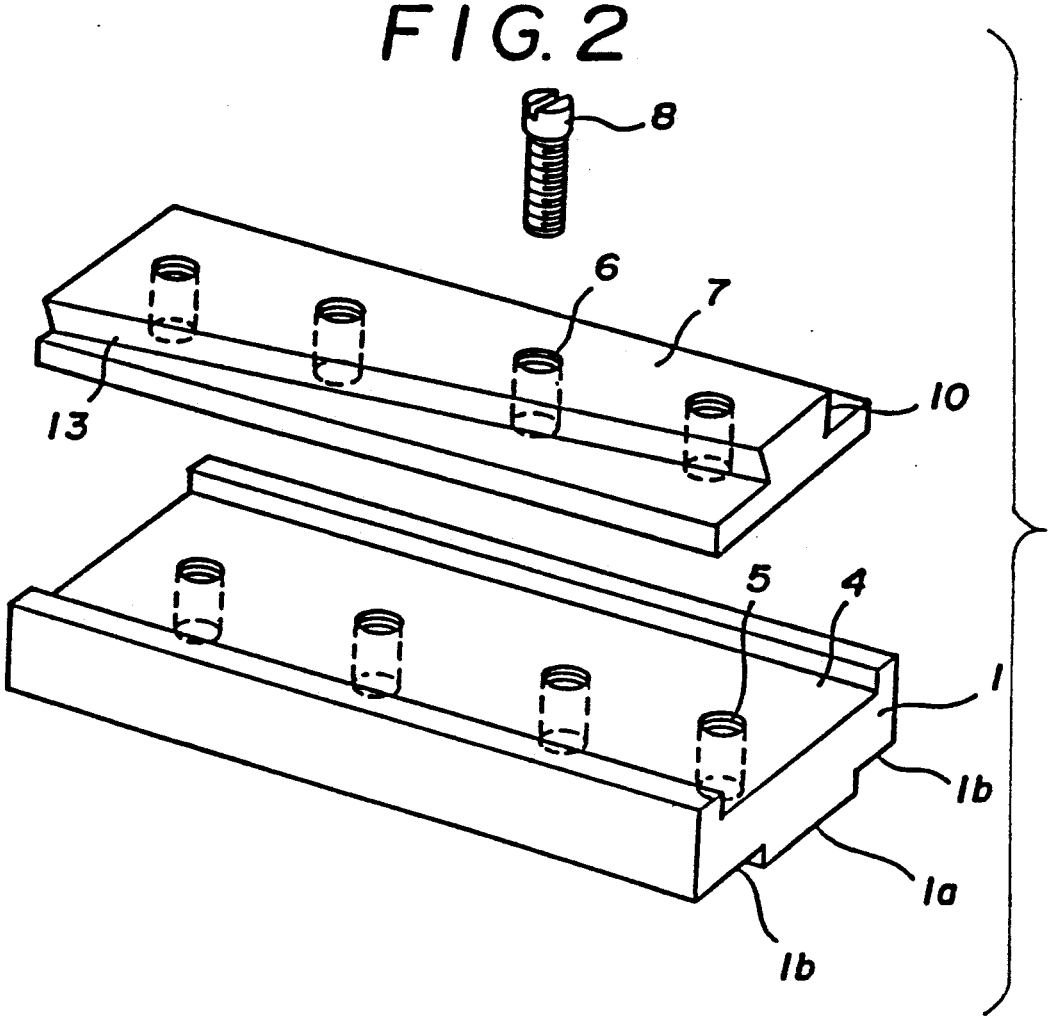
FIG. 2 is an exploded perspective view of the polishing-grindstone mount base assembly disassembled into the base body, mount cassette and fixing bolts; and, FIG. 3 is a sectional view taken along the line A—A of FIG. 1.
Figure 3:
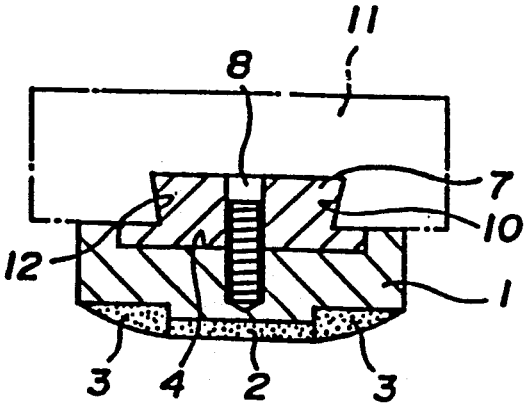

In the drawings, the reference numeral 1 indicates a rectangular base body made of a synthetic resin such as phenolic resin, polyvinyl chloride (PVC) or the like, having an abrasive grain layer 2 of a predetermined thickness and made of a sintered mixture of abrasive grain and pulverized diamond formed as swollen on an abrasive grain layer receiving surface 1a in the central area of the bottom thereof, and a resin layer 3 for protection of the abrasive grain layer 2, the resin layer 3 being formed as circularly swollen on each side 1b of the abrasive grain layer 2. Further, the base body 1 has formed on the top thereof a fitting recess 4 in which a plurality of screw holes 5 for bolts is formed along the centerline thereof. The reference numeral 7 indicates a mount cassette made of rigid rubber which is to be fitted into the fitting recess 4 and has formed therein screw holes 6 corresponding to the screw holes 5 in the fitting recess 4. The rectangular base body 1 and the mount cassette 7 are fixed to each other by bolts 8 made of a synthetic resin, the bolts 8 being received in the screw holes 5 and 6, thereby forming a polishing-grindstone mount base assembly 9. The bolts 8 will be broken when more than a predetermined load is applied.

For assembling the cassette, a dovetail-like rib 10 having a wedge-like surface as indicated at 13 along each lateral side thereof is longitudinally formed on the top of the mount cassette 7, and a dovetail groove 12 having a wedge-like wall at either side thereof is formed in the mount arm 11 of the polisher. The dovetail-like rib 10 is inserted into the dovetail groove 12 from one end thereof and fixed as force-fitted due to the wedge-like surfaces 13 formed longitudinally on the dovetail-like rib 10 and the wedge-like walls of the dovetail groove 12.

Next, the function of the polishing-grindstone mount base assembly according to the present invention will be described below. First, by inserting the dovetail-like rib 10 formed on the top of the mount cassette 7 of the polishing-grindstone mount base assembly 9 into the dovetail groove 12 formed in the bottom of the mount arm 11 of the polisher from the narrow end of the wedge-like surface 13, the mount cassette 7 is securely fixed to the mount arm 11 under the action of the wedge-like surfaces 13.

In this condition, a stone (not shown) is polished while the polishing-grindstone mount base assembly 9 is being rotated with the bottom surface of the mount base assembly 9 being forced against the stone surface.

However, even if a part of the mount base assembly 9 is put in contact with a corner or the like of the stone by mistake during polishing, the protective resin layer 3 bears against the stone to protect the abrasive grain layer 2 from damage. The protective resin layers 3 at opposite sides of the abrasive grain layer 2 will be only slightly injured as the case may be. Further, when the mount base assembly 9 strongly hits the corner or the like of the stone and so is applied with a large load, the bolts 8 of synthetic resin which join together the lowest base body 1 and the mount cassette 7 will be ruptured with a predetermined load, so that the base body 1 will be separated from the mount cassette 7. This means that the mount cassette fitted in the mount arm will not be damaged, and the base body 1, which carries the abrasive grain layer 2, has not been broken and can be fixed to the cassette 7 with new bolts 8 for reuse.

As has been described above, since the polishing-grindstone base according to the present invention has a protective resin layer formed as circularly swollen on either side of the abrasive grain layer attached in the central area of the bottom surface thereof, the abrasive grain layer can be prevented from being destroyed when the base body touches a stone or a like material being worked by the polishing-grindstone. Also since the polishing-grindstone mount base assembly according to the present invention is of such a structure that the base body, having an abrasive grain layer formed thereon, and the mount cassette, which is to be fitted into the mount arm, are joined together with bolts made of a synthetic resin which will be ruptured on application of a predetermined load, if the polishing grindstone is applied with a larger contact shock than necessary when put into contact with a stone to be worked, the fixing bolts made of the synthetic resin are ruptured, resulting in separation of the base body and mount cassette from each other. Thus, the mount cassette can be prevented from being broken. Since the mount cassette is made of a rigid rubber, it absorbs the vibration applied during polishing, withstands the shock and thus will not be broken. So the mount cassette and base body can be reused when joined together with new bolts. Furthermore, since the mount cassette is made of the rigid rubber, if made in somewhat larger size, it can be securely fitted in the dovetail groove in the mount arm. Thus, it can be used for a long term.

It will of course be understood by those skilled in the art that the embodiment of the invention here presented is by way of illustration only, and is meant to be in no way restrictive; therefore, numerous changes and modification may be made, and the full use of equivalents resorted to, without departing from the spirit or scope of the invention as outlined in the appended claims.

I claim:

1. A polishing-grindstone mount base assembly comprising a polishing-grindstone base 1, and a mount cassette 7 for carrying said base, said polishing-grindstone base including a rectangular base body, an abrasive grain layer 2 formed as swolen in the central area of the rectangular bottom surface of said base body, said abrasive grain layer being formed of a sintered mixture of a pulverized diamond and abrasive grain, and a protective layer 3, said protective layer being formed as circularly swolen on the bottom surface of said base body on each side of said abrasive grain layer, said protective layer being formed of synthetic resin.

2. A polishing-grindstone mount base assembly as claimed in claim 1, said mount cassette being made of a rigid rubber, said base body defining a recess for receiving said mount cassette, said mount cassette including a wedge-like rib formed on the top thereof, each side of said wedge-like rib defining a dove-tail like surface, said mount cassette and said base body defining aligned threaded holes, and at least one bolt received in said aligned threaded holes for holding said base body to said cassette, said at least one bolt being formed of a synthetic resin.

3. A polishing-grindstone base, comprising a rectangular base body, an abrasive grain layer formed as swolen in the central area of the rectangular bottom surface of said base body, said abrasive grain layer being formed of a sintered mixture of pulverized diamond and abrasive grain, and a protective layer, said protective layer being formed as circularly swollen on the bottom surface of said base body on each side of said abrasive grain layer, said protective layer being formed of a synthetic resin.

* * * * *